US005385176A

United States Patent [19]

Price

[11] Patent Number: 5,385,176

[45] Date of Patent: Jan. 31, 1995

[54] NATURAL GAS DISPENSING

[75] Inventor: Billy F. Price, Houston, Tex.

[73] Assignee: Price Compressor Company, Inc., Houston, Tex.

[21] Appl. No.: 94,494

[22] Filed: Jul. 19, 1993

[51] Int. Cl.[6] ..... B65B 31/00

[52] U.S. Cl. ..... 141/1; 141/4; 141/12; 141/18; 141/71; 141/83

[58] Field of Search ..... 141/1, 4, 12, 18, 47, 141/51, 63, 65, 71, 83, 82

[56] References Cited

U.S. PATENT DOCUMENTS

| | | | |
|---|---|---|---|
| 1,339,431 | 5/1920 | Backhaus | 141/4 |
| 3,837,377 | 9/1974 | McJones | 141/4 |
| 4,153,085 | 5/1979 | Imler et al. | 141/4 |
| 4,527,600 | 7/1985 | Fisher et al. | 141/4 |
| 4,805,674 | 2/1989 | Knowlton | 141/47 |
| 4,860,803 | 8/1989 | Wells | 141/9 |
| 4,966,206 | 10/1990 | Baumann et al. | 141/83 |
| 4,987,932 | 1/1991 | Pierson | 141/1 |

FOREIGN PATENT DOCUMENTS

| | | | |
|---|---|---|---|
| 1130715 | 12/1984 | U.S.S.R. | 141/4 |

OTHER PUBLICATIONS

Public Service company of Colorado, Team NGV Natural Gas Vehicles Pamphlet (no date).

Brochure of CNG Equipco (no date).

*Industry News, Natural Gas Fuels,* Jan. 1993, pp. 6, 7 and 9.

*Industry News, Natural Gas Fuels,* vol. 1, Iss. 1, Aug. 1992, pp. 6–9.

Tri-Fuels Incorporated, Catalog at pp. 26, 52, and 53 (no date).

Brochure of Natural Gas Resources, Inc. (no date).

Brochure of Tri-Fuels Incorporated (no date).

*Primary Examiner*—Ernest G. Cusick

*Attorney, Agent, or Firm*—Pravel, Hewitt, Kimball & Krieger

[57] ABSTRACT

The invention provides a method and apparatus that conserves energy in the filling of a storage tank with natural gas and dispensing natural gas from the storage tank to receiving tanks. The invention permits the refueling of gas receiving tanks at a fueling rate comparable to that achieved with liquid hydrocarbon fuels, such as gasoline and diesel. The apparatus includes the use of at least two compressors: a first compressor and a second compressor, in series with and drawing less horsepower than the first, for compressing natural gas into a storage tank up to a certain pressure level that fills the tank. Upon demand for gas from the storage tank, the second compressor alone may be used to withdraw gas from the storage tank and supply gas at a fueling rate to a receiving tank. When pressure in the storage tank drops to below a predetermined pressure level, the first compressor is brought on line to replenish gas in the storage tank to maintain the fueling rate through the second compressor.

10 Claims, 1 Drawing Sheet

NATURAL GAS DISPENSING

BACKGROUND OF THE INVENTION

1. Field of the Invention

The invention relates to a method and apparatus for the dispensing of natural gas. More particularly, the invention provides a method and apparatus for filling a storage tank with natural gas and removing natural gas from this storage tank for dispensing to a user, such as a natural gas consuming vehicle.

2. Description of the Related Art

Due to increasing environmental concerns, vehicle manufacturers are under pressure to convert to motor fuels that produce lower amounts of pollutants. Carbon dioxide, a byproduct of the combustion of hydrocarbon fuels, is now considered as a pollutant insofar as this gas contributes to a "hot house effect" which is expected to significantly raise the general temperature of the Earth's environment with potentially disastrous consequences. One method of reducing the production of carbon dioxide has been to use hydrocarbon fuels that have a higher proportion of hydrogen relative to carbon. Natural gas is such a fuel. Therefore, there has been increasing pressure, due to environmental concerns, to convert entire fleets of vehicles so that they can consume natural gas rather than gasoline or diesel fuel.

Under usual conditions, natural gas is supplied by pipeline under low pressure to storage facilities. At the storage facility, the natural gas is compressed, using large compressors, into large storage vessels at pressures up to about 4,000–5,000 psi. Natural gas can then be dispensed from these large storage vessels into the fuel tanks of vehicles. However, as natural gas is removed from the storage vessel, the gas pressure in the vessel declined. As the pressure in the vessel declined, the rate of discharge of natural gas from the large pressure vessel to the fuel tank also declined, especially since the vehicle fuel tanks must be filled to a pressure of at least about 2,400 psi or even higher. Therefore, storage vessels have so far as known only been capable of supplying gas at a declining rate of flow, as the pressure gradually dropped and approached the vehicle tank pressure. This declining and overall relatively slow rate of filling user vehicles has been a significant impediment to the conversion of vehicles to the use of natural gas since filling a vehicle under these conditions could take several hours.

In order to overcome the slow filling rate obstacle, "fast-fill cascade" systems have been developed. However, these systems also have limitations. In a fast-fill cascade system, natural gas has been supplied via a compressor to a series of compressed gas storage cylinders. These storage cylinders have been initially charged at high pressure, typically about 3,600 psi. The vehicle requiring a refill of fuel was hooked up to one of these compressed gas cylinders. Once the gas in that particular one of the cylinders dropped below a certain pressure or required feed rate, the cylinder was taken out of service. A second cylinder in the series was then brought into service to provide fuel. This cylinder operation was designed to be carried out automatically by controlled valves so that there was a relatively continuous flow of fuel to the vehicle. However, fast-fill cascade systems of this type have been expensive, requiring large numbers of high pressure gas cylinders and associated valving and controls. Further, in order to fuel a large fleet of vehicles, such as the buses for a large metropolitan area transit system, a vast number of fast-fill cascade high pressure cylinders would be required. This would require a substantial capital investment. The same is true for natural gas service stations selling gas to the general public who require fast service (rapid fueling rates). This situation is made worse by the fact that the capital investment is not normally economically justifiable, but is necessitated by environmental concerns. Gasoline or diesel fuel is virtually always cheaper.

There has existed a need for a capability of rapidly fueling vehicles with compressed natural gas (CNG) or vapors from liquid natural gas (LNG) with a short fueling time per vehicle. Further, the means should desirably require relatively low capital investment while meeting safety and environmental standards.

SUMMARY OF THE INVENTION

The present invention provides a method and apparatus that conserves energy in the filling of a storage tank with natural gas and dispensing natural gas from the storage tank to a receiving tank, such as a receiving tank in a vehicle using natural gas fuel. Further, the invention permits the refueling of gas receiving tanks at a fueling rate comparable to that achieved with liquid hydrocarbon fuels such as gasoline and diesel.

The method according to the invention includes the steps of receiving natural gas from a source; compressing the natural gas into a storage tank using a first compressor with a drive motor in a series with a second compressor having a lower horsepower drive motor, up to a first predetermined pressure level; storing the natural gas in the storage tank; and on demand dispensing natural gas from the storage tank to receiving tanks. This dispensing is initially by free-flowing gas from the storage tank to receiving tanks. However, when pressure in the storage tank declines to below a second pressure level, and dispensing or fueling rate declines, then the second compressor is brought on line for removing natural gas from the storage tank and compressing it to the receiving tanks. In this manner, the fueling rate is maintained at a level acceptable to customers and up to about 70% or more of the gas in the storage tank is removable enabling better utilization of tank storage space.

The invention overcomes a major factor discouraging the conversion of vehicles from gasoline or diesel to natural gas: the time for fueling the vehicle. Whereas a gasoline or diesel car with a 15 gallon tank can be refueled in 3 to 4 minutes, previous natural gas delivery systems (aside from the cascade system) could not deliver fuel at such a rate. The invention provides the capability to refuel a tank with natural gas having the energy equivalent of 15 gallons of gasoline in about two to four minutes. Further, it does not have the disadvantages of the cascade system, explained above.

The invention provides a method and apparatus that allows lower energy utilization in dispensing natural gas from storage tanks to receiving tanks at an acceptable fueling rate. By using two compressors instead of only one, the lower horsepower compressor alone may be used to dispense fuel. Thus, the energy used is considerably less than would be used when one large compressor equivalent to the two compressors of the invention is used to dispense fuel.

In permitting the more rapid fueling of receiving tanks with natural gas, the invention also encourages the conversion of consumers from liquid hydrocarbon fuels to efficient natural gas fuel and thereby allows further energy conservation (because of the higher efficiency of natural gas combustion) and enhancement of the environment through reduced carbon dioxide emissions (because of the higher hydrogen: carbon ratio of natural gas). Consequently, the invention is of great significance in the areas of energy conservation and preservation of the environment.

BRIEF DESCRIPTION OF THE DRAWINGS

A better understanding of the present invention can be obtained when the following detailed description of the preferred embodiment is considered in conjunction with the following drawings, in which.

DETAILED DESCRIPTION OF THE PREFERRED EMBODIMENTS

The invention provides a method and apparatus that conserves energy and facilitates the conversion of consumers utilizing hydrocarbon liquid fuel to natural gas fuel thereby materially enhancing air quality. The invention removes the disadvantage of most prior art compressed natural gas systems that require long periods of time to refuel the receiving tanks of consumers, such as the fuel tanks of motor vehicles using natural gas as a fuel source.

Energy is conserved by using less horsepower to compress natural gas from a storage vessel to individual receiving tanks. Enhancement of air quality is achieved through the encouragement of consumers to convert from the use of liquid hydrocarbon fuels, that emit higher proportions of carbon dioxide as a combustion product, than fuel gas that has a higher proportion of hydrogen relative to carbon.

In the specification, the term "fueling rate" is a rate of fueling a tank of a vehicle using natural gas that is acceptable to consumers and that fills a tank with 2,300 standard cubic feet (the BTU equivalent of 20 gallons of gasoline) in about 2 to about 5 minutes, approximately the time required to fill a standard 20-gallon gasoline or diesel fuel tank. (Based on the assumption that 115 standard cubic feet of natural gas (methane) has the same amount of energy as one gallon of gasoline.)

In the specification, the term "natural gas" refers to natural gas which is substantially methane or gas obtained as vapors from liquid natural gas.

Figure 1:
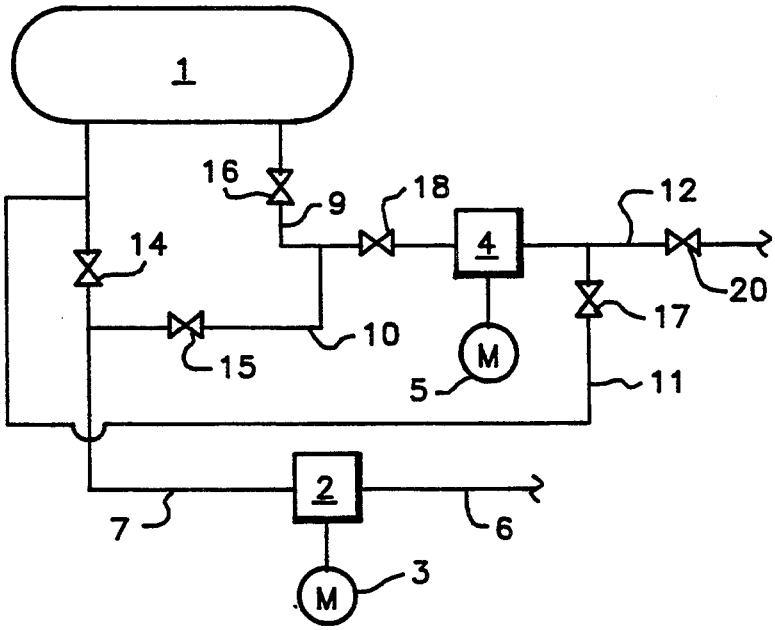
FIG. 1 is a schematic diagram of an apparatus according to the present invention.

The invention is better understood with reference to FIG. 1 which illustrates an embodiment of the invention in a schematic flow diagram. In a preferred method for filling the storage tank 1, natural gas is obtained from a source (not shown) through conduit 6 and fed into the inlet side of compressor 2 driven by motor 3. Compressor 2 compresses the gas and discharges it into conduit 7 which conveys the gas through open valve 15 (valve 14 is closed) through conduit 10 and thence through open valve 18 (valve 16 is closed) into the inlet side of compressor 4 driven by motor 5. Compressor 4 further compresses the gas and discharges the gas into conduit 11 through open valve 17 (valve 9 is closed) thence to storage tank 1. This process of charging storage tank 1 with natural gas continues until a predetermined pressure level is achieved. This pressure level may approximate the ultimate discharge pressure of compressor 4; at this point storage tank 1 is deemed full.

After filling the storage tank, valve 16 is opened, valve 15 is closed, valve 18 is opened, valve 17 is closed, and valve 20 is opened and the apparatus of the present invention is ready to dispense gas on demand. Upon demand, when the storage tank 1 is fully pressurized, compressed gas can free-flow to a vehicle fuel tank without need for compression until the pressure drops to such a level that the fueling rate is less than desired. At this point, compressor 4 is brought on line. Compressor 4 is started up and compressed natural gas is withdrawn from storage tank 1 through conduit 9 into the suction of compressor 4 for compressing into conduit 12 and thence to the receiving tank (not shown). If, during supply of natural gas to a receiving tank, the pressure in storage tank 1 drops below a certain predetermined pressure level so that compressor 4 fueling rate drops to below a desired level, then compressor 2 may be started up to replenish storage tank 1 with compressed gas. In this event, valve 15 is closed and valve 14 is opened so that compressed natural gas flows from the exit of compressor 2 through conduit 7 into storage tank 1.

When demand has been satisfied, compressors 2 and 4 are operated, as explained above, to refill storage tank 1.

Figure 2:
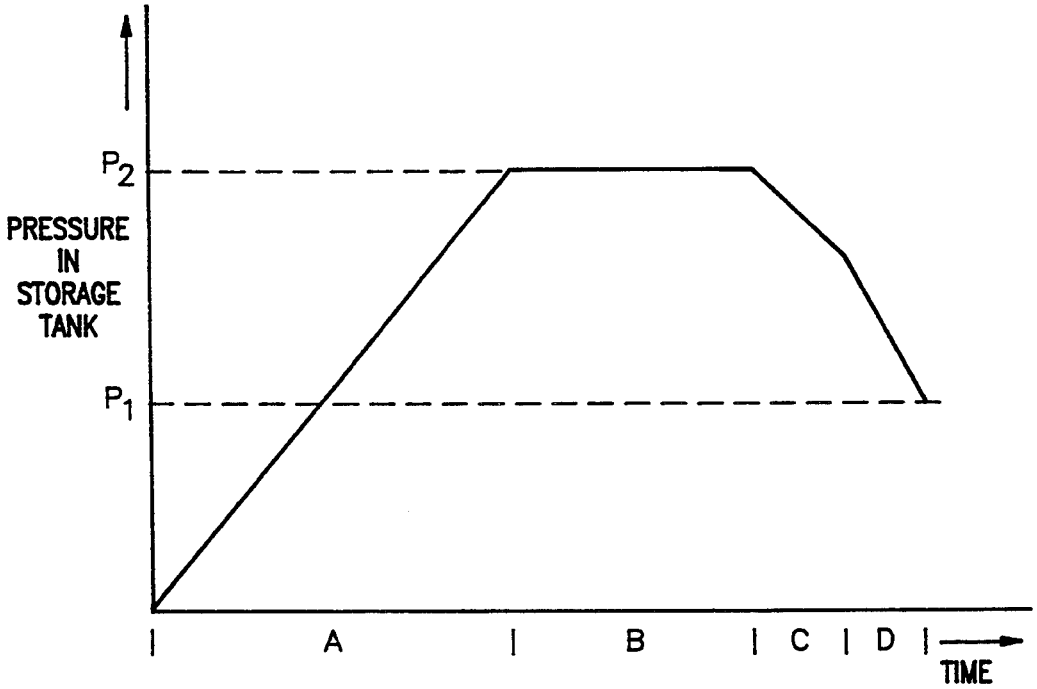
FIG. 2 is a graph of pressure in a storage tank as a function of time when an embodiment of the invention apparatus and method is used.

The cyclical use of the apparatus and method of the invention is further explained with reference to FIG. 2, a graphic representation of the variation of pressure in storage tank 1 with time. During time period A, compressors 2 and 4 operate in series to compress gas to storage tank 1 until pressure P2 is reached. At this point, storage tank 1 is regarded as fully charged. After the elapse of time period B, there is a demand for gas from the storage tank. At this point, compressed gas may be released from storage tank 1 to a vehicle fuel tank without need for compression since P2 is significantly greater than the maximum pressure required to fill the fuel tank. However, at some point after the elapse of time C, the pressure differential between the storage tank 1 and the receiving fuel tank will be reduced to such a level that the flow rate of compressed gas to the fuel tank is below a desired minimum rate. At this point, compressor 4 is brought on line and operates for a time period D until the pressure in tank 1 drops to P1. Compressor 4 is then shut down and valving is rearranged so that compressors 2 and 4 again operate in series to refill storage tank 1. The cycle is then repeated.

Energy is saved by the apparatus and process according to the invention because the use of a single large compressor to dispense compressed gas to a receiving tank is eliminated. Instead, a much lower horsepower compressor is used.

The following example is illustrative of the operating principles according to the invention. It should be understood, however, that the example does not in any way limit the scope of the invention as described above and claimed below.

EXAMPLE 1

Comparison of the Invention with a System Using a Single Compressor

In a prototype system constructed according to the invention, schematically represented in FIG. 1, a storage tank of 90 gallon capacity was charged to 4,000 psi in about 1.5 hours using a first compressor with a 60 horsepower motor and a second compressor, in series with the first compressor, with a motor drawing 30 horsepower. Therefore, during the filling cycle of 1.5 hours, about 229,000 BTU of energy were used. A single compressor having a 90 horsepower motor used for 1.5 hours fills the storage tank to the same pressure and uses about the same amount of energy.

On demand, when compressed natural gas is required at 4,000 psi and a rate of 5 gpm, the smaller of the two compressors (30 HP) used according to the invention is able to supply the compressed gas over a period of 4 minutes. Thus, the invention uses about 5,100 BTU. In contrast, when the single large horsepower compressor is used, then the receiving tank is filled in 4 minutes using 90 horsepower, representing about 15,300 BTU.

Further, when using a one-compressor system, the fueling rate is limited to about 1.2 gallons per minute from a storage tank pressurized at 3,000 psi. At best, 30–40% of the total fuel in the storage tank can be removed using a single compressor. In contrast, in the two-compressor system, a fueling rate of 5.5 gallons per minute can be obtained with a storage tank pressurized to 3,000 psi, and a fueling rate of 1.2 gallons per minute with a storage tank pressurized to 900 psi. Further, the single compressor system uses more energy as pointed out above: 90 horsepower versus the 30 horsepower used by the smaller of the two compressors in the system of the invention. Also, the system according to the invention recovers 75% of the total amount of fuel from a fully pressurized storage tank, thereby allowing better utilization of storage tanks.

Although the invention has been described with reference to its preferred embodiments, such as flow rates of natural gas, horsepower of compressors, and the like, those of ordinary skill in the art may, upon reading this disclosure, appreciate changes and modifications which may be made to the apparatus and process which do not depart from the scope and spirit of the invention as described above and claimed below.

What is claimed is:

1. An energy conserving process for filling a storage tank with compressed natural gas and dispensing compressed natural gas from the storage tank to receiving tanks, comprising the steps of:

receiving gas from a source into a suction end of a first compressor;

compressing the gas by means of the first compressor to a first pressure level;

further compressing compressed gas from the first compressor with a second compressor, of lower horsepower than the first compressor, to a second pressure level, greater than the first pressure level, into the storage tank; and on demand removing compressed gas from the storage tank using the second compressor to a receiving tank at a fueling rate.

2. The process of claim 1, wherein the natural gas is substantially methane gas.

3. The process of claim 2, wherein the removing at a fueling rate is removing at a rate that provides substantially the energy of a gasoline fuel transfer rate of from about 4.0 to about 10.0 gallons per minute.

4. The process of claim 1 further comprising replenishing the storage tank with gas compressed by the first compressor while removing compressed gas from the storage tank using the second compressor.

5. An apparatus for conserving energy while filling a storage tank with compressed natural gas and dispensing compressed natural gas from the storage tank to receiving tanks, the apparatus comprising:

a storage tank for storing compressed natural gas;

a first compressor for compressing gas, having a motor drawing a first horsepower, said first compressor having a discharge end for supplying gas compressed to a first pressure level to the storage tank;

a conduit with an end thereof connected to the discharge end of the first compressor and another end thereof connected to an inlet end of a second compressor;

a second compressor able to receive compressed gas from the discharge end of the first compressor and discharge further compressed gas into the storage tank, said second compressor equipped with a motor requiring a second horsepower;

a second conduit from the storage tank to the inlet end of the second compressor for conveying compressed gas to the second compressor; and a third conduit extending from the discharge end of the second compressor connectable to a receiving tank for conveying compressed gas from the storage tank in a further compressed state to the receiving tank at a fueling rate.

6. The apparatus of claim 5, wherein the second horsepower is less than the first horsepower.

7. The apparatus of claim 6, wherein the natural gas is substantially methane gas.

8. An energy conserving process for filling a storage tank with compressed natural gas and dispensing compressed natural gas from the storage tank to receiving tanks, the process comprising:

receiving natural gas from a source into a suction end of a first compressor;

using the first compressor to compress the gas;

charging compressed gas from a discharge end of the first compressor to an inlet end of a second compressor;

further compressing compressed gas with the second compressor to from about 3,000 to about 4,000 psi in the storage tank;

on demand removing compressed gas from the storage tank and compressing removed gas with the second compressor to a receiving tank; and compressing gas to the storage tank with the first compressor when pressure in the tanks drops to less than about 1,000 psi while the step of removing gas from the tank is being carried out.

9. The process of claim 8 further comprising supplying compressed gas from the storage tank to a fuel receiving tank at a fueling rate.

10. The process of claim 9, wherein the natural gas is substantially methane.

* * * * *